US011759089B2

(12) United States Patent
Connors et al.

(10) Patent No.: US 11,759,089 B2
(45) Date of Patent: Sep. 19, 2023

(54) LINT BRUSH

(71) Applicant: Helen of Troy Limited, St. Michael (BB)

(72) Inventors: Daniel John Connors, Brooklyn, NY (US); Conor Patrick McNamara, Montclair, NJ (US); Benjamin Beck, Boston, MA (US); Douglas A. Marsden, Marblehead, MA (US); Ryan Donovan, Newton, MA (US); Michael McDuffee, Gloucester, MA (US); Jonathan Mark Liston, Somerville, MA (US); Phillip Seagram, Somerville, MA (US); Marina Eaves, Boston, MA (US)

(73) Assignee: Helen of Troy Limited, St. Michael (BB)

( * ) Notice: Subject to any disclaimer, the term of this patent is extended or adjusted under 35 U.S.C. 154(b) by 141 days.

(21) Appl. No.: 17/189,305

(22) Filed: Mar. 2, 2021

(65) Prior Publication Data

US 2022/0280019 A1 Sep. 8, 2022

(51) Int. Cl.
*A47L 25/00* (2006.01)

(52) U.S. Cl.
CPC ..... *A47L 25/005* (2013.01)

(58) Field of Classification Search
CPC ..... A47L 25/005; A47L 13/16; A46B 7/023
USPC ..... 15/104.002, 230.11
See application file for complete search history.

(56) References Cited

U.S. PATENT DOCUMENTS

| | | | | |
|---|---|---|---|---|
| 3,747,152 | A | 7/1973 | Tsuruzawa | |
| 4,442,565 | A * | 4/1984 | Zierhut | A46B 17/06 15/25 |
| D309,376 | S | 7/1990 | Kiesz | |
| 8,201,303 | B2 | 6/2012 | Niederman | |
| 10,219,676 | B2 | 3/2019 | Woolman | |
| D862,899 | S | 10/2019 | Vasilakes | |
| 2008/0216295 | A1 | 9/2008 | Tipton | |
| 2010/0251495 | A1 * | 10/2010 | Knopow | A47L 25/005 15/104.002 |
| 2011/0078866 | A1 | 4/2011 | Panthofer | |

(Continued)

FOREIGN PATENT DOCUMENTS

| | | |
|---|---|---|
| CN | 108742472 | 11/2018 |
| EP | 3245928 | 11/2017 |
| JP | S6258564 | 4/1987 |

(Continued)

OTHER PUBLICATIONS

EP Search Report filed in EP 22159616 dated Jan. 20, 2023.

*Primary Examiner* — Thomas Raymond Rodgers
(74) *Attorney, Agent, or Firm* — RANKIN, HILL & CLARK LLP

(57) ABSTRACT

A lint brush includes a housing and a lint tool having a lint-removing material. The lint tool is movable along a longitudinal axis of the housing between a stowed position where the lint tool is housed in the housing and a deployed position where the lint tool is extended from the housing. The lint tool is rotatable relative to the longitudinal axis from the deployed position to a first rotated position. An actuator is mounted to one of the housing and the lint tool. The actuator is configured to move the lint tool from the first rotated position back to the deployed position.

20 Claims, 10 Drawing Sheets

(56) References Cited

U.S. PATENT DOCUMENTS

2016/0256034 A1* 9/2016 Woolman ..... A47L 25/005

FOREIGN PATENT DOCUMENTS

| | | |
|---|---|---|
| JP | 2010-273758 | 12/2010 |
| KR | 2001-0073649 | 8/2001 |
| WO | 2019122823 | 6/2019 |

* cited by examiner

LINT BRUSH

BACKGROUND

A commonly used lint brush consists of a roll of a lint-removing adhesive-bearing material rotatably mounted on a spindle of a brush portion, attached to a handle. In use, the user rolls the lint brush around the spindle over or along a surface to be cleaned and any fibers or lint on the surface adheres to the lint-removing adhesive material. Another commonly used lint brush consists of a lint-removing brush material secured on a brush portion, attached to a handle. The brush material is typically a directional material, i.e., a material that can be drawn in a first direction (a "pick-up direction") across a surface to be cleaned to pick up fibers or lint from the surface, and drawn in an opposite direction (a "release direction") across the surface to release the fibers or lint from the brush material. It is also known to provide a lint brush wherein a brush portion having one of the above lint-removing materials is movable into and out of a handle.

SUMMARY

According to one aspect, a lint brush comprises a housing and a lint tool having a lint-removing material. The lint tool is movable along a longitudinal axis of the housing between a stowed position where the lint tool is housed in the housing and a deployed position where the lint tool is extended from the housing. The lint tool is rotatable relative to the longitudinal axis from the deployed position to a first rotated position. An actuator is mounted to one of the housing and the lint tool. The actuator is configured to move the lint tool from the first rotated position back to the deployed position.

According to another aspect, a lint brush comprises a housing and a lint tool. The lint tool includes a shuttle and a tool body having a lint-removing material mounted thereto. The lint tool is movable along a longitudinal axis of the housing between a stowed position where the lint tool is housed in the housing and a deployed position where the lint tool is extended from the housing. The lint tool is rotatable relative to the longitudinal axis from the deployed position to a first rotated position. An actuator is provided as part of the lint tool and coupled between the shuttle and the tool body. The actuator is configured to move the lint tool from the first rotated position back to the deployed position.

DETAILED DESCRIPTION

Figure 1:
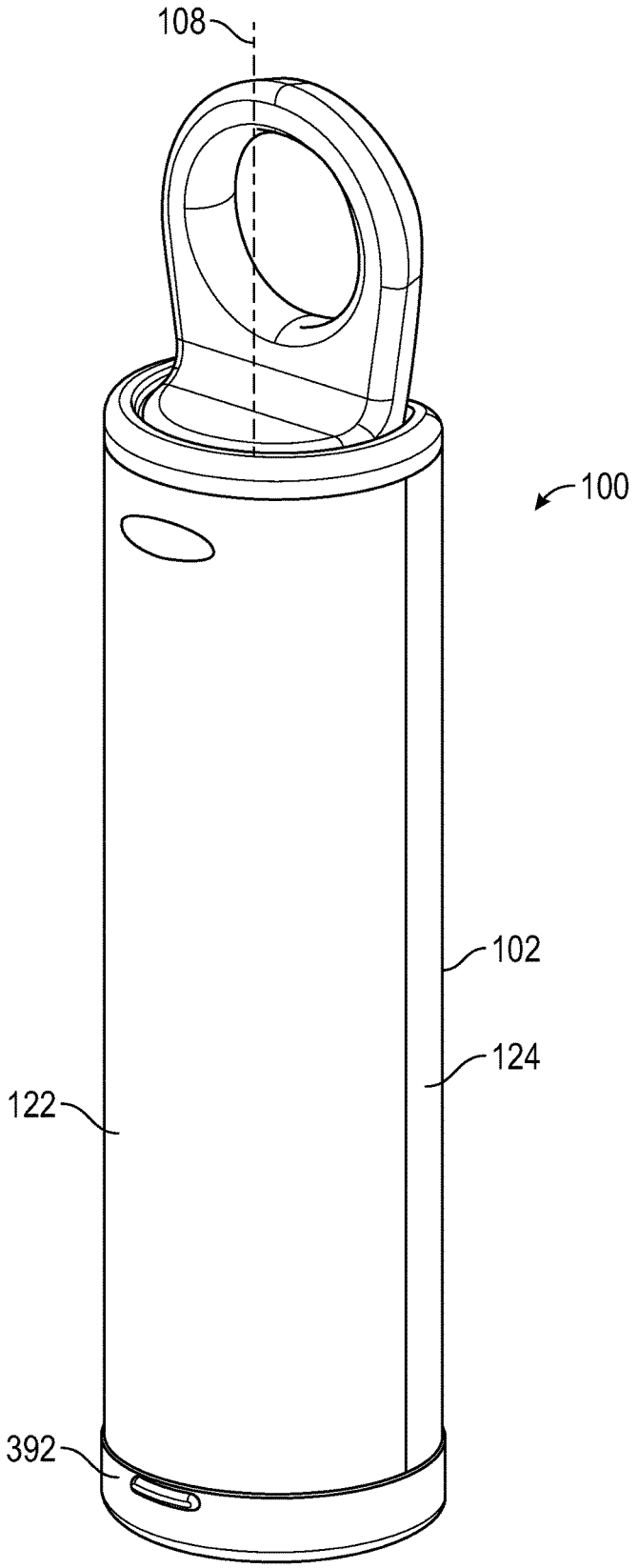
FIG. 1 is a perspective view of a lint brush according to the present disclosure, the lint brush including a housing and a lint tool, the lint tool in a stowed position relative to the housing.
Figure 2:
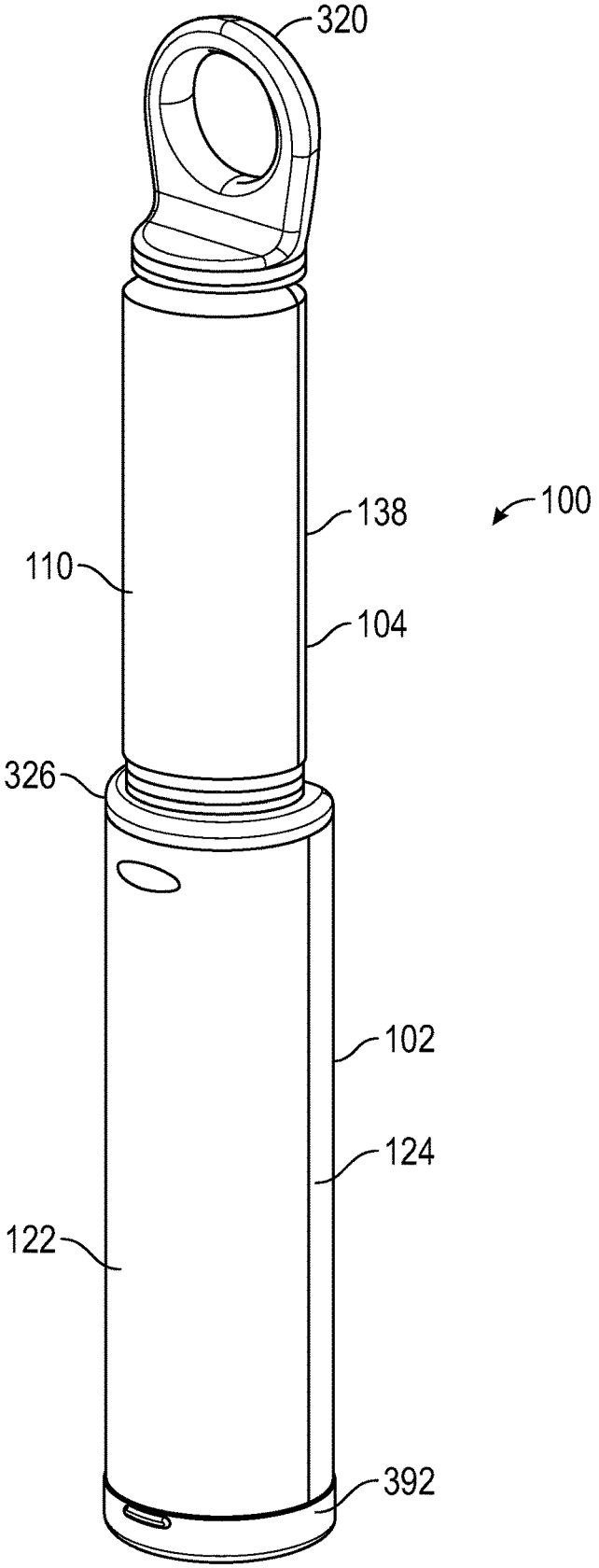
FIG. 2 is a perspective view of the lint brush, the lint tool in a deployed position relative to the housing.
Figure 3:
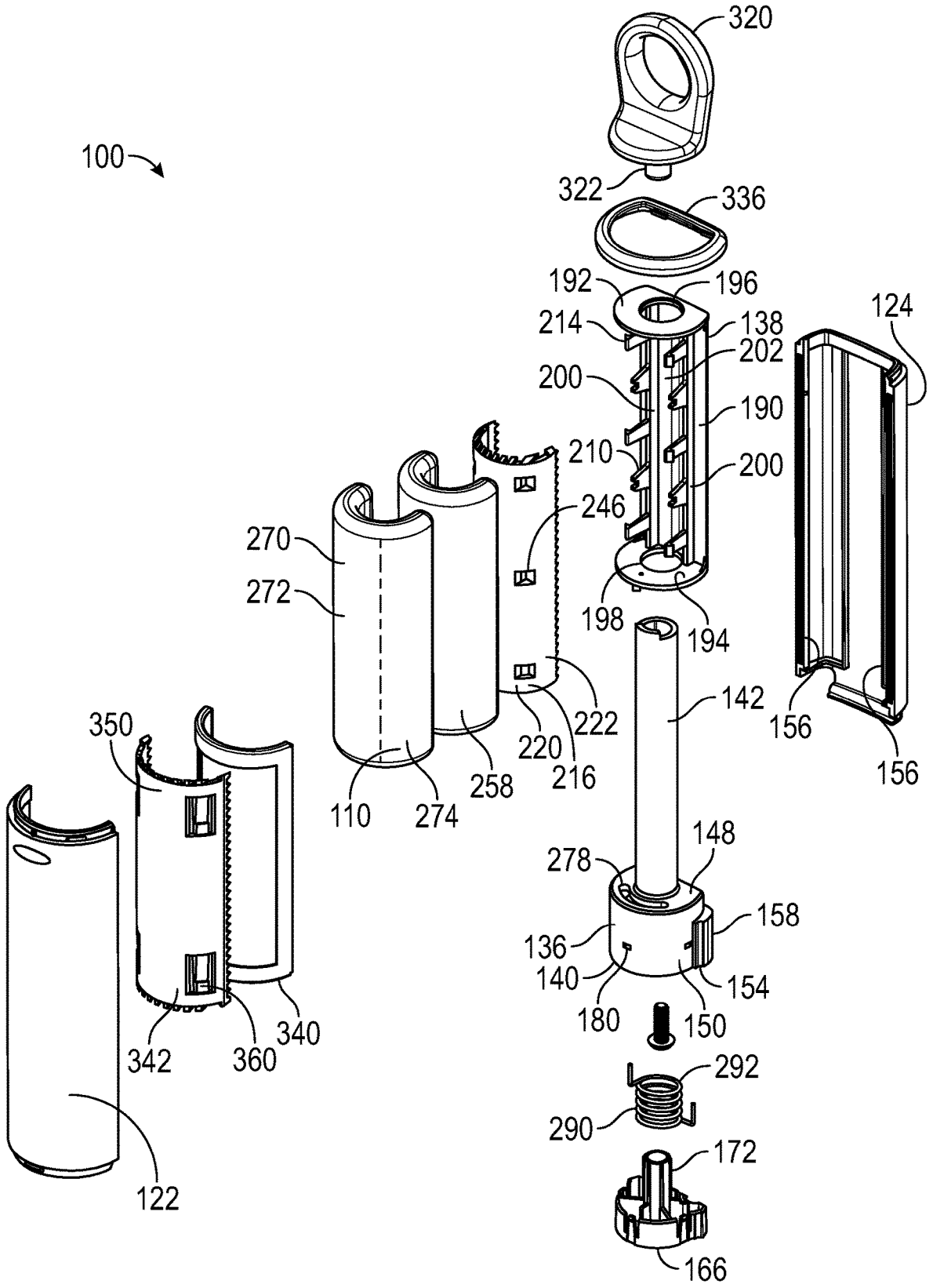
FIG. 3 is an exploded perspective view of the lint brush.
Figure 9:
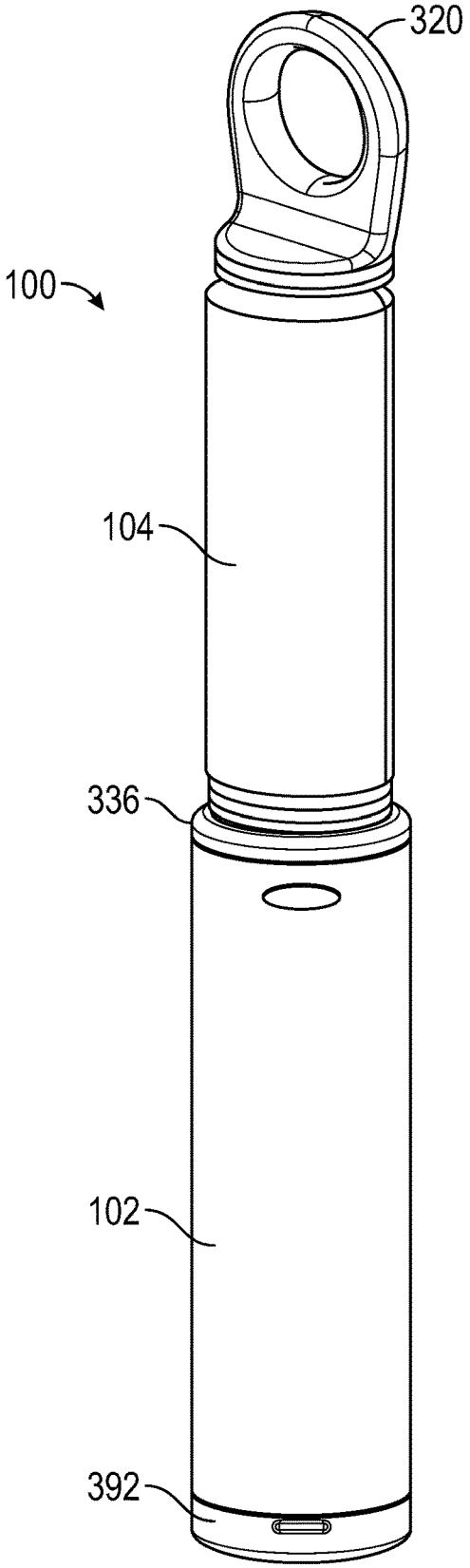
FIG. 9 is a perspective view of the lint brush, the lint tool in a first rotated position.
Figure 10:
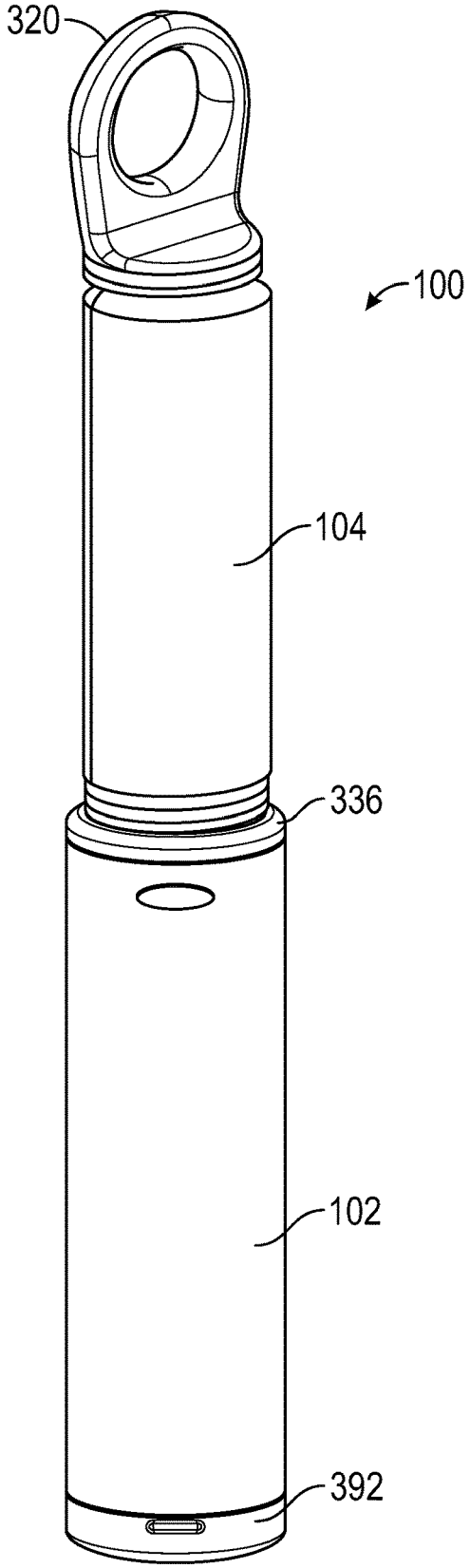
FIG. 10 is a perspective view of the lint brush, the lint tool in a second rotated position.
Figure 11:
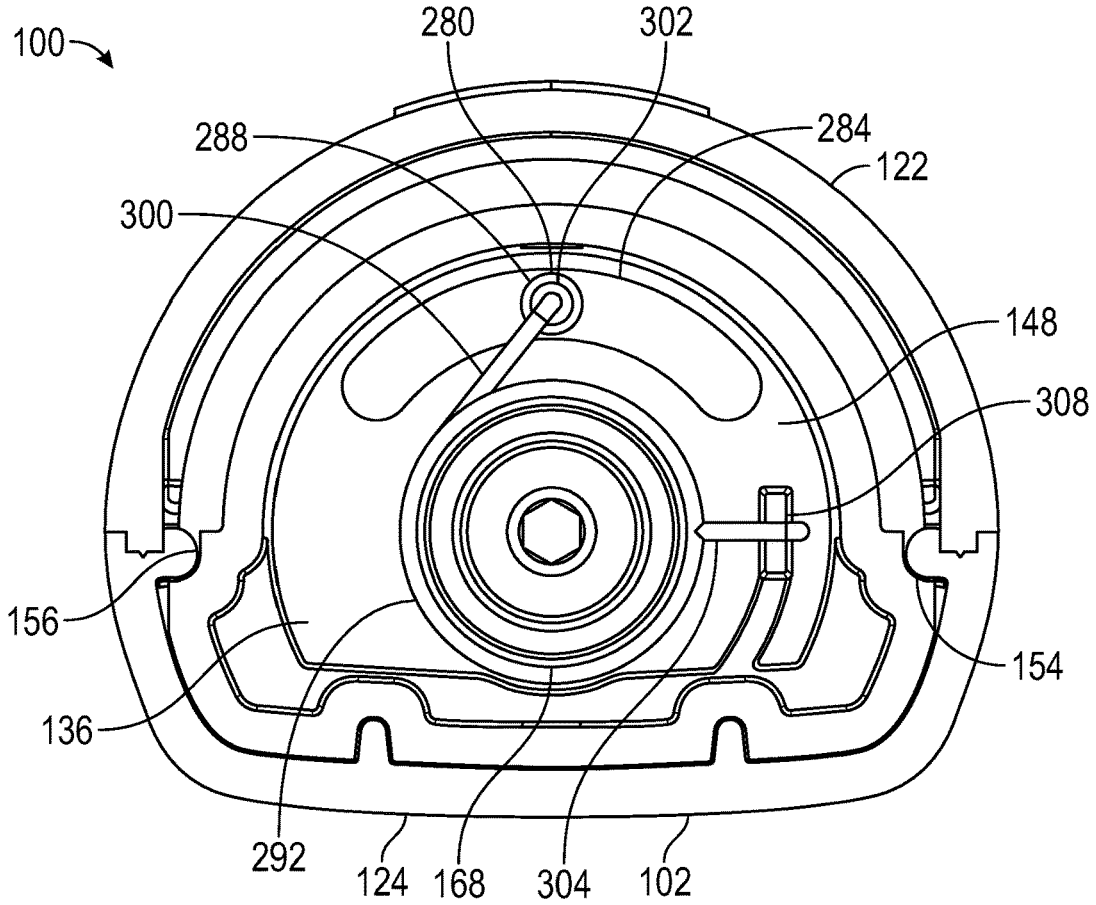
FIG. 11 is a transverse cross-sectional view of FIG. 1.

It should, of course, be understood that the description and drawings herein are merely illustrative and that various modifications and changes can be made in the structures disclosed without departing from the present disclosure. Spatially relative terms, such as "beneath," "below," "lower," "above," "upper" and the like may be used to describe an element and/or feature's relationship to another element(s) and/or feature(s) as, for example, illustrated in the figures. Referring now to the drawings, wherein like numerals refer to like parts throughout the several views, FIGS. 1-3 illustrate a lint brush 100 according to the present disclosure. The lint brush 100 comprises a housing 102 and a lint tool 104 movable along a longitudinal axis 108 of the housing 102 between a stowed position (FIG. 1) where the lint tool 104 is housed in the housing 102 and a deployed position (FIG. 2) where the lint tool is extended from the housing. As will be described below, the lint tool 104 is also rotatable relative to the longitudinal axis 108 from the deployed position to at least a first rotated position (FIG. 9 or FIG. 10). The lint tool 104 has mounted thereto a lint-removing material 110 adapted to remove fibrous material from a surface. As used herein "fibers" or "fibrous material" includes debris such as human or pet hair, dust, lint, string, thread and other such materials that collect on surfaces. As used herein when referring to surfaces being cleaned, "surface" includes fabric or fabric-covered surfaces including clothing, upholstery, carpet, blankets, curtains, and other such surfaces on which fibers tend to collect, and can also include hard surfaces, such as tile, linoleum, wood, and the like.

Figure 4:
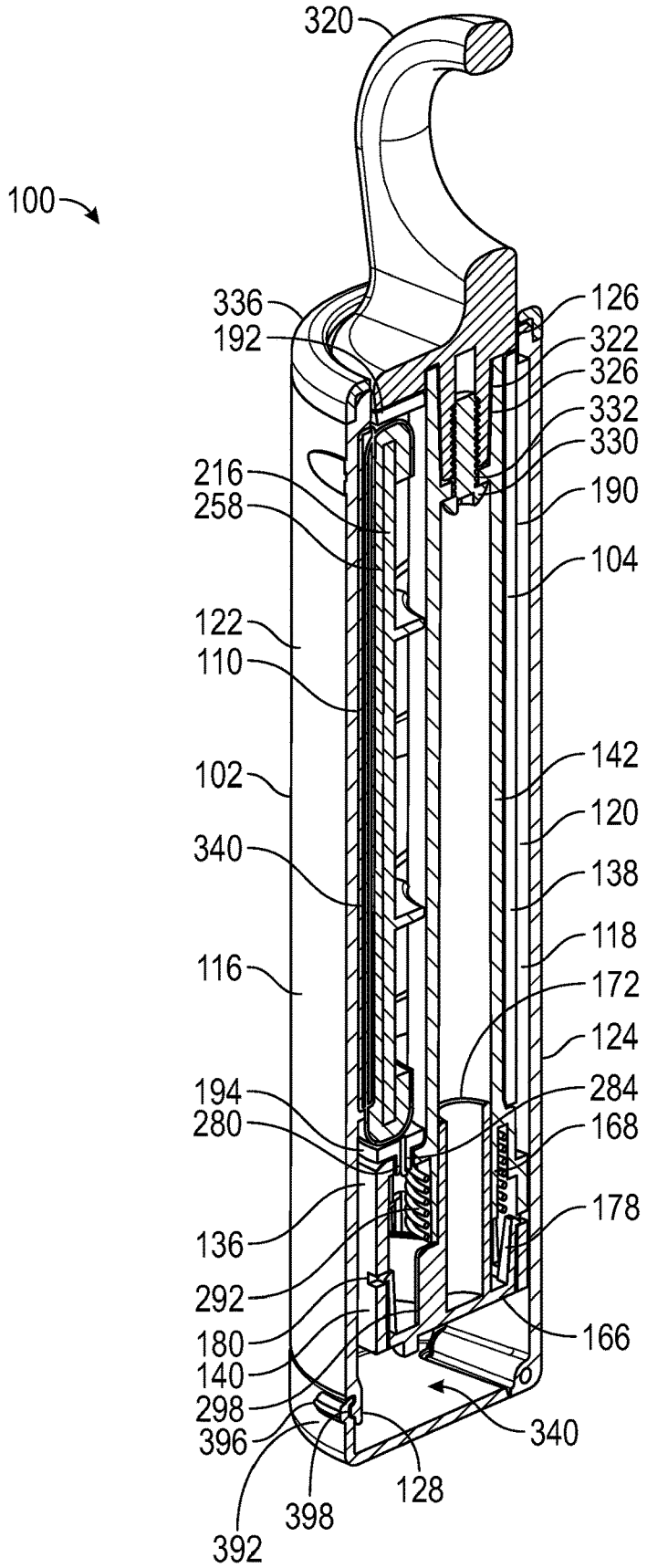
FIG. 4 is a longitudinal cross-sectional view of FIG. 1.
Figure 5:
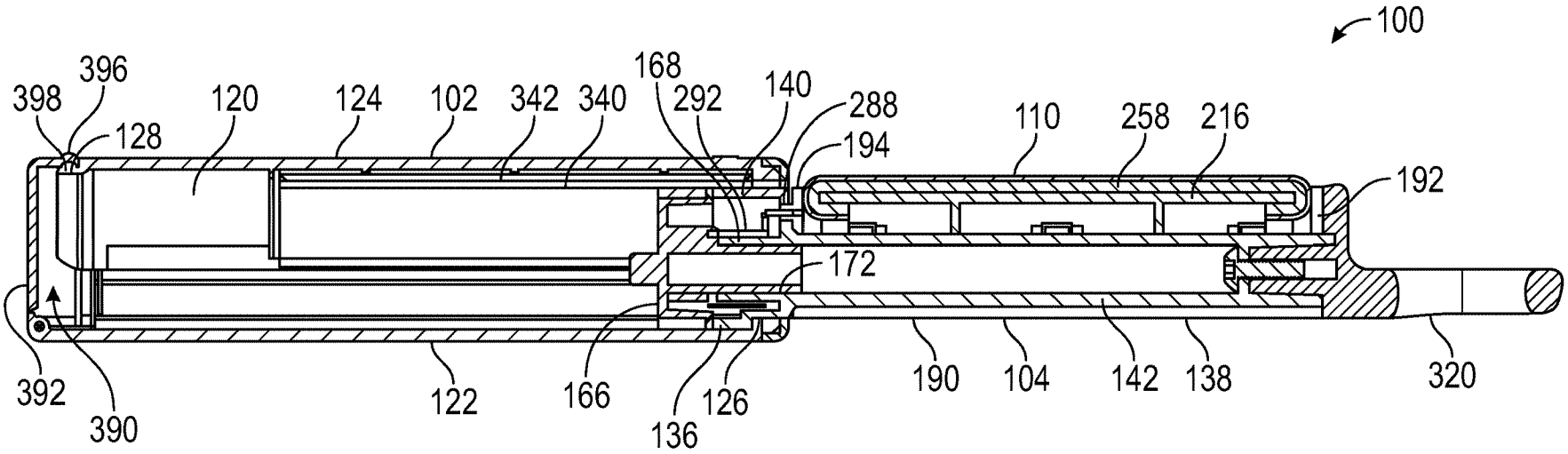
FIG. 5 is a longitudinal cross-sectional view of FIG. 2.
Figure 6:
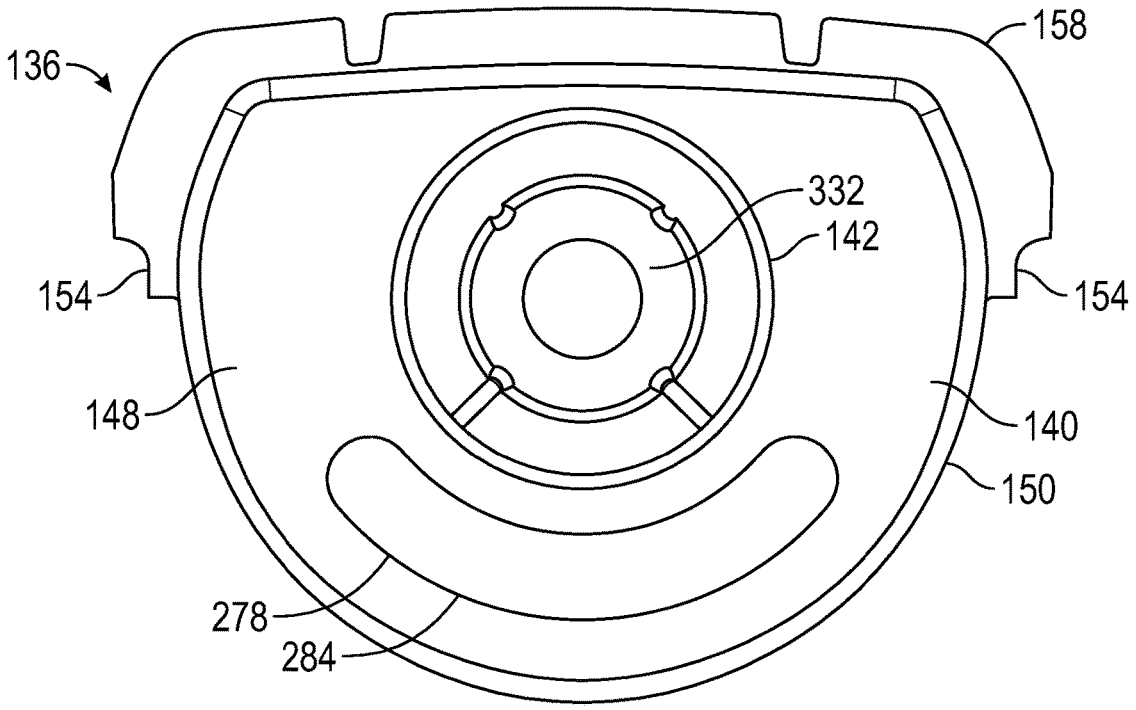
FIG. 6 is a top plan view of a shuttle of the lint tool.
Figure 7:
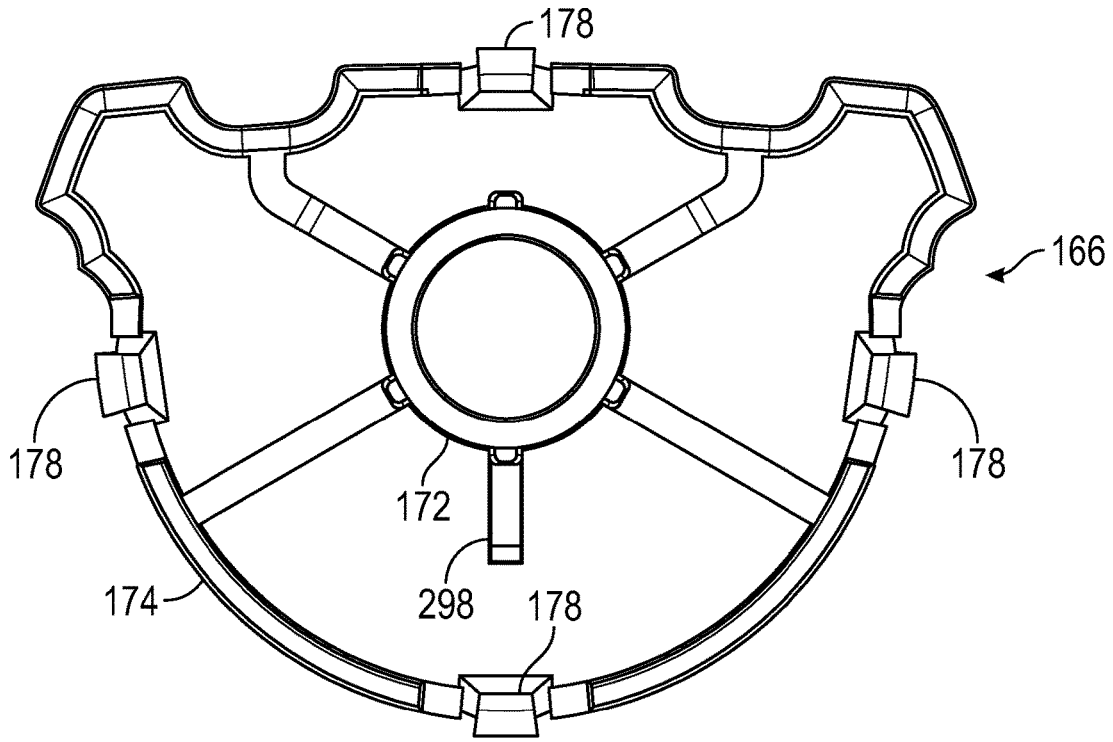
FIG. 7 is a top plan view of a shuttle cap of the lint tool.

In the depicted embodiment of FIGS. 4 and 5, the housing 102 includes an exterior surface 116 and an interior surface 118 that defines an inner chamber 120 sized to receive the lint tool 104 in the stowed position. For ease of assembly, the housing 102 can be a two-piece housing including a first housing part 122 and a second housing part 124 attached to the first housing part 122. The first housing part 122 can be arcuate shaped and the second housing part 124 can be square U-shaped, which allows for proper positioning of the lint tool 104 as the lint tool is moved to the stowed position; although, alternative shaped are contemplated. The inner chamber 120 may have a size and shape sufficient to receive the lint-removing material 110 of lint tool 104. For example, referring to FIG. 4, the inner chamber 120 may have a longitudinal dimension that is larger than the corresponding longitudinal dimension of the lint-removing material 110, so that the entire lint-removing material 110 may fit entirely within the inner chamber. The inner chamber 120 of the housing 102 has a distal opening 126 and a proximal opening 128. In this context, "distal" refers to the area through which the lint tool 104 is deployed and "proximal" refers to the area away from which the lint tool is deployed. It can be appreciated that the exterior surface 116 of the housing 102 can be configured for functional or aesthetic purposes, for example for easy gripping by a user.

With reference to FIGS. 3-7, the lint tool 104 includes a shuttle 136 and a tool body 138 adapted to support the lint-removing material 110. As shown, the shuttle 136 includes a base 140 and a post 142. The base 140 includes an upper wall 148 with the post 142 extending outwardly therefrom and a sidewall 150. According to the present disclosure, the base 140 is guided along a longitudinal dimension of the housing 102 as the lint tool 104 is moved between the stowed position and the deployed position. By way of example, one of the shuttle 136 and the housing 102 includes a guide track 154 and the other of the shuttle 136 and the housing 102 includes a guide 156 movable in the guide track as the lint tool is moved relative to the housing 102. In the depicted aspect, the sidewall 150 of the shuttle 136 includes the guide track 154 and the second housing part 124 of housing 102 includes the guide 156. The guide track 154 can be provided on an extension 158 mounted to the sidewall 150; although, this is not required. The guide 156 can be formed as longitudinal ribs on the second housing part 124. Further, opposite the upper wall 148 of the shuttle base 140 a shuttle cap 166 can be provided to close an open end of the base 140. To allow for the mounting of the cap 166, a boss 168 depends from the upper wall 148 and defines a bore sized to receive a stem 172 provided on the cap 166. The cap 166 includes a sidewall 174 separated into sections by engagement tabs 178. With the sidewall 174 of the cap 166 positioned within the base 140 of the shuttle 136, the engagement tabs 178 are received in openings 180 in the sidewall 150.

Figure 8:
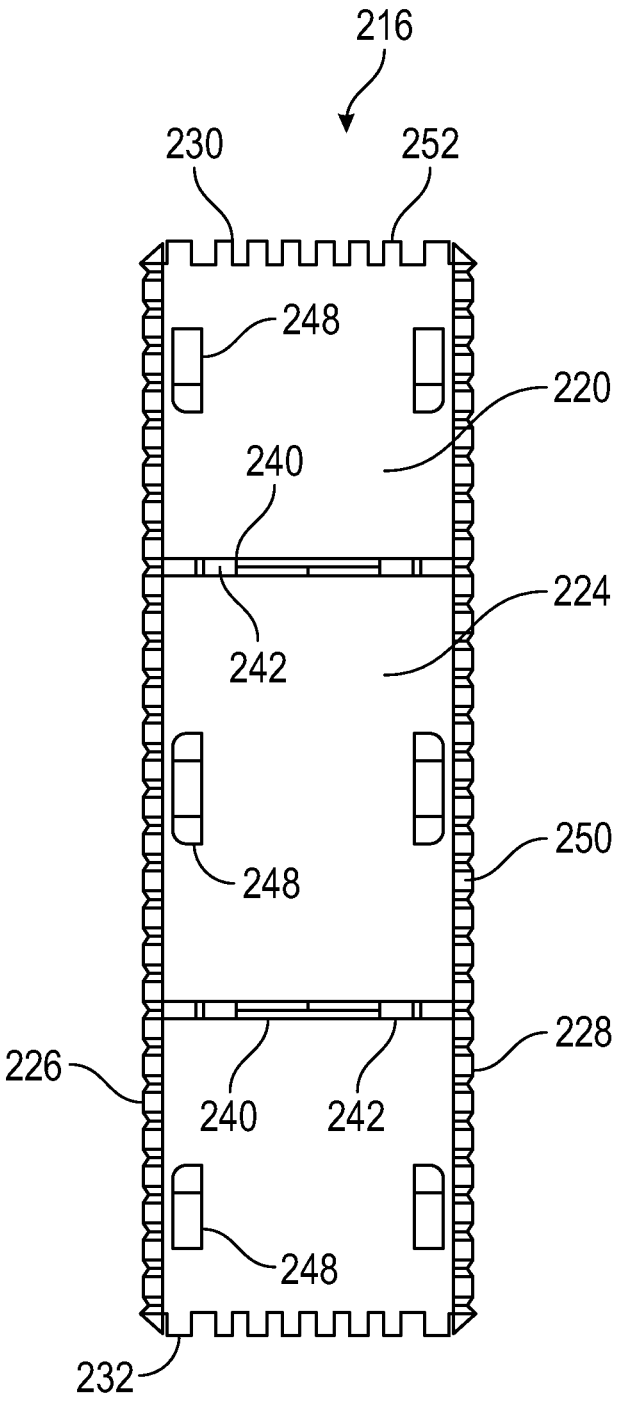
FIG. 8 is an insider or rear view of a backing member for the lint tool.

With continued reference to FIGS. 3-5, the tool body 138 is freely supported on the shuttle 136, meaning that the tool body 138 is not fixed in position on the shuttle 136. To this end, the tool body 138 includes a supporting wall 190 having upper and lower flanges 192, 194 extended from opposite end portions. The flanges 192, 194 include openings 196, 198 sized to receive the post 142 of the shuttle 136. Further, the supporting wall 190 can including elongated spaced ribs 200 that together with the supporting wall define a channel 202 for the post 142. In the depicted aspect, locating tabs 210 and mounting tabs 214 extend from the supporting wall 190 for engagement with a backing member 216 for the lint-removing material 110. In FIGS. 3 and 8, the backing member 216 includes a generally C-shaped body 220 with an outer surface 222, and inner surface 224, side edges 226, 228 and upper and lower edges 230, 232. Shelves 240 extend from the inner surface 224 and are provided with notches 242 which receive the locating tabs 210. The body 220 is further provided with openings 246 at least partially flanked by mounting flanges 248 on the inner surface 224. The openings 246 at least partially receive the mounting tabs 214 when engaged to the mounting flanges 248. In the present aspect, each of the side edges 226, 228 can be provided with teeth 250 and each of the upper and lower edges 230, 232 can be provided with teeth 252. A compressible pad 258 (e.g., a foam pad) for the lint-removing material 110 can be secured to the outer surface 222 of the backing member 216, and the teeth 250, 252 can assist in the securing of the compressible pad 258 to the outer surface 222.

The lint-removing material 110 is secured to the compressible pad 258 by any suitable means. For example, the lint-removing material 110 may be permanently attached to selected portions of the compressible pad 258 by adhesives, mechanical connections, or chemical bonds. In other embodiments, lint-removing material 110 may be releasably affixed to the compressible pad 258, so that one or both may be removed and replaced such as when it becomes ineffective. As is known in the art, the lint-removing material 110 is a directional brush material, i.e., a material that can be drawn in a first direction (a "pick-up direction") across a surface to be cleaned to pick up fibrous material from the surface, and drawn in an opposite direction (a "release direction") across the surface to release the fibrous material from the brush material. For example, the brush material may be a directional pile fabric having a plurality of short fibers that lean in one direction. When the brush material is drawn in one direction across a surface to be cleaned, it picks up fibrous material from the surface. Dragging the brush material in an opposite direction across a surface removes some or all of the collected fibrous material from the brush material. According to the present disclosure, the lint-removing material includes a continuous tool surface 270 composed of first and second fabric sections 272, 274 (shown separated by the hidden line in FIG. 3) having brush material with oppositely-oriented fabric piles. With this arrangement, the pick-up and release directions of the first and second fabric sections 272, 274 are reversed.

As indicated previously, the lint tool 104 is rotatable relative to the longitudinal axis of the housing 102 from the deployed position (FIG. 2) to a first rotated position (e.g., FIG. 9). More particularly, the tool body 138 when positioned on the post 142 of the shuttle 136 is rotatable relative to the shuttle 136. To guide the rotational movement of the tool body 138, one of the shuttle 136 and the tool body 138 includes a guide track 278 and the other of the shuttle 136 and the tool body 138 includes a guide 280 movable in the guide track 278 as the lint tool is rotated. In the depicted aspect of FIGS. 4-6, the shuttle 136 includes the guide track 278 and the tool body 138 includes the guide 280. The guide track 278 is defined by an arcuate slotted opening 284 formed in the upper wall 148 of the shuttle 136, and the guide 280 is defined by a pin 288 depending from the lower flange 194 of the tool body 138, the pin 288 sized to extend through the slotted opening 284. It should be appreciated that the slotted opening 284 defines the rotational extent of the tool body 138 relative to the shuttle 136, with ends of the slotted opening defining hard stops for the tool body.

Figure 12:
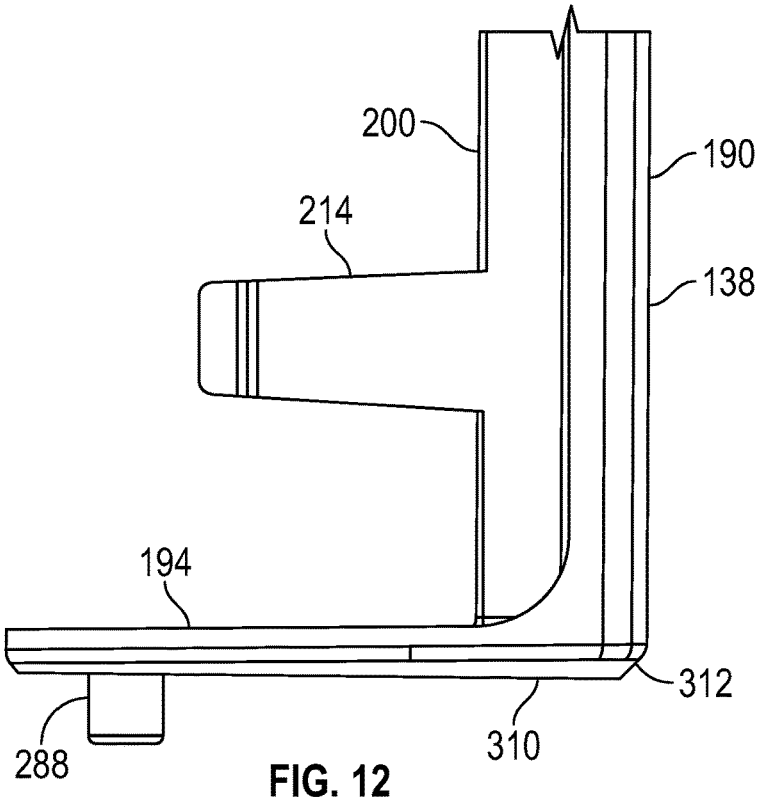
FIG. 12 is an enlarged partial side view of a tool body of the lint tool.
Figure 14:
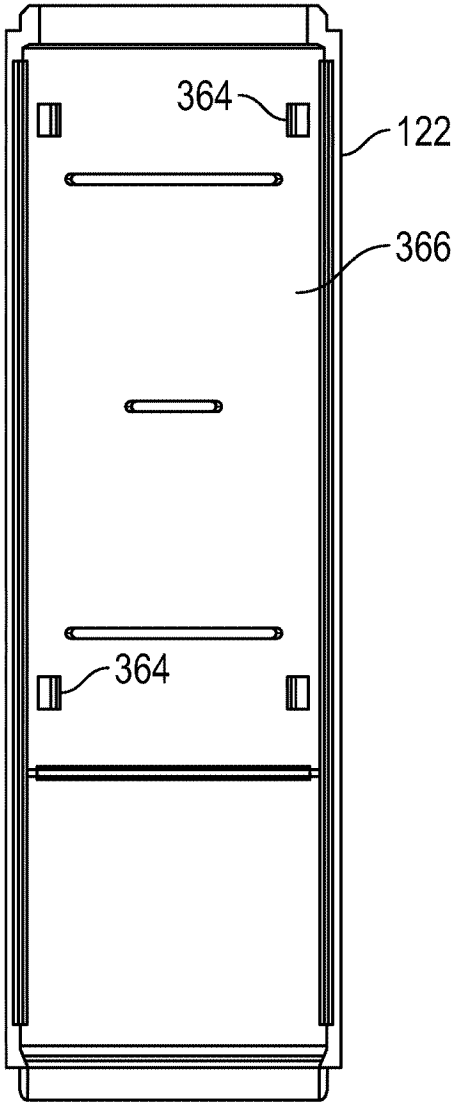
FIG. 14 an insider or rear view of a housing part of the housing.
Figure 13:
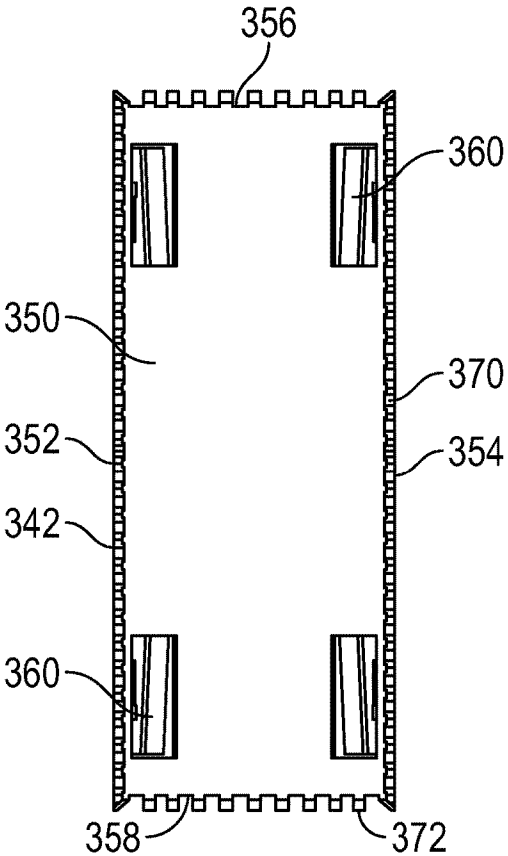
FIG. 13 an insider or rear view of a backing member for a cleaning pad housed in the housing.

Further to the present disclosure an actuator 290 mounted to one of the housing 102 and the lint tool 104 is configured to move the tool body 138 from the first rotated position back to the deployed position. It should be appreciated that the term "actuator" and variations thereof mean an element, component, device or mechanism, which is designed, configured and/or operable to automatically move the lint tool back to the deployed position, which is the position required to move the lint tool 104 back into the housing 102 to the stowed position. In the present aspect, the actuator 290 is coupled between the shuttle 136 and the tool body 138, specifically the guide 280. Therefore, the actuator 290 moves with the lint tool 104, allowing for a more compact housing 104. Further, according to the present embodiment, the actuator 290 is a biasing member in the form of a spring 292, and as depicted, the spring 292 is a torsion spring; however, alternative springs (e.g., extension springs) can be used to move the tool body 138 back to the deployed portion. In FIGS. 3-5 and 11, the spring 292 is positioned on the boss 168 depending from the upper wall 148 of the shuttle 136 and is maintained on the boss by a rib or fin 298 on the shuttle cap 166. One leg 300 of the spring 292 is secured in an opening 302 formed in the guide 280 or pin 288. The other leg 304 of the spring 292 is secured in catch 308 provided, for example, on the upper wall 148. With this arrangement, rotation of the tool body 138 on the shuttle 136 toward the first rotated position (e.g., by moving the first section 272 of the lint-removing material 110 in a first direction transverse to the longitudinal axis of the housing 102 across a surface to be cleaned) twists the spring legs 300, 304 along a spring axis, which, in turn, exerts a torque in an opposite direction that when the lint-removing material 110 is removed from the surface moves the lint tool back 104 to the deployed position. Additionally, due to the arcuate shape of the slotted opening 284, the lint tool 104 is also rotatable in a second opposite direction relative to the longitudinal axis of the housing 102 from the deployed position (FIG. 2) to a second rotated position (e.g., FIG. 10) (e.g., by moving the second section 274 of the lint-removing material 110 in a second direction transverse to the longitudinal axis of the housing 102 across a surface to be cleaned). And the actuator 290 is configured to move the lint tool 104 from the second rotated position back to the deployed position in a similar manner as described above. FIG. 12 is an enlarged partial side view of the lower flange 194 of the tool body 138. A wedge-shaped feature 310 with an increasing thickness toward the supporting wall 190 is provided on the lower flange 194. A lead-in surface 312 of the feature 310 is canted or angled toward the supporting wall 190 to correct for any imprecision in the spring 292, so that minor misalignment between the tool body 138 and the housing 102 and/or shuttle 136 as the tool body 138 is rotated back to the deployed position does not prevent the tool body 138 from being moved into the stowed position.

To maintain the tool body 138 on the shuttle 136, a handle 320 is removably attached to the post 142 such that the tool body is secured between the shuttle and the handle. To attach the handle 320, the handle can include a boss 322 with a threaded opening that can be received in a bore 326 of the post 142, and a fastener 330 extended through a washer 332 formed in the bore 326 is threadingly received in the boss opening. An aesthetic ring-shaped trim member 336 can be mounted on the distal opening 126 of the housing, and the ring member 336 can assist in connecting the first and second housing parts 122, 124.

With reference to FIGS. 3-5, 13 and 14, a cleaning pad 340 is mounted within the housing 102, the cleaning pad being adapted to engage the lint-removing material 110 and remove fibrous material from the lint-removing material as the lint tool 104 is moved between the stowed position and the deployed position. In the depicted aspect, a backing member 342 secures the cleaning pad 340 to the first housing part 122. The backing member 342 includes a generally C-shaped body 350 with side edges 352, 354 and upper and lower edges 356, 358. The body 350 is provided with openings 360 sized to receive mounting tabs 364 extended from an inner surface 366 of the first housing part 122. In the present aspect, each of the side edges 352, 354 can be provided with teeth 370 and each of the upper and lower edges 356, 358 can be provided with teeth 372. The cleaning pad 340 can be secured to an inner surface 378 of the backing member body 350, and the teeth 370, 372 can assist in the securing of the cleaning pad 340 to the backing member 342. Similar to the lint-removing material 110, the cleaning pad 340 is permanently or releasably secured to the backing member 342 by any suitable means. The cleaning pad 340 may be made of any material suitable for removing fibrous material from the brush material. For example, the cleaning pad 340 may be a directional pile fabric, as described above, which has directional piles of fibers facing toward the lint-removing material 110. One having ordinary skill in the art will appreciate the types of material that may be used in the cleaning pad 340 to effectively remove fibrous material from the lint-removing material 110 of the lint tool 104. Further to the cleaning pad 340, the housing 102 includes a collection area 390 located beneath the shuttle cap 166 for collecting fibrous material removed from the lint-removing material 110. A door 392 is mounted to the housing 104 at the proximal opening 128. For example, the door 392 can be hingedly connected to the second housing part 124, and a latch 396 formed on the door can selective engage a protrusion 398 formed on the first housing part 122. The door 392 is movable from a closed position for covering the collection area 390 (and the proximal opening 128 of the housing 102) and an opened position allowing for removal of fibrous material from the collection area 390.

It will be appreciated that the above-disclosed embodiments and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A lint brush comprising:

a housing;

a lint tool having a lint-removing material, the lint tool having a handle at a distal end allowing the lint tool to be movable along a longitudinal axis of the housing between a stowed position where the lint tool is housed in the housing and a deployed position where the lint tool is extended from the housing, wherein the lint tool is rotatable relative to the longitudinal axis from the deployed position to a first rotated position by moving the lint-removing material in a first direction transverse to the longitudinal axis across an associated surface to be cleaned; and an actuator including a biasing member mounted to one of the housing and the lint tool, the biasing member configured to move the lint tool from the first rotated position back to the deployed position when the lint-removing material is removed from the associated surface.

2. The lint brush of claim 1, wherein a cleaning pad is mounted within the housing, the cleaning pad adapted to engage the lint-removing material and remove fibrous material from the lint-removing material.

3. The lint brush of claim 2, wherein the housing includes a collection area for collecting fibrous material removed from the lint-removing material.

4. The lint brush of claim 3, wherein a door is mounted to the housing, the door movable from a closed position for covering the collection area and an opened position allowing for removal of fibrous material from the collection area.

5. The lint brush of claim 1, wherein the lint tool includes a shuttle and a tool body supporting the lint-removing material, and the biasing member is coupled between the shuttle and the tool body.

6. The lint brush of claim 5, wherein one of the shuttle and the tool body includes a guide track and the other of the shuttle and the tool body includes a guide movable in the guide track as the lint tool is rotated between the deployed position and the first rotated position.

7. The lint brush of claim 6, wherein the shuttle includes the guide track and the tool body includes the guide, and the biasing member is coupled between the shuttle and the guide.

8. The lint brush of claim 5, wherein the handle is removably attached to the shuttle, and the tool body is secured between the shuttle and the handle.

9. The lint brush of claim 5, wherein one of the shuttle and the housing includes a guide track and the other of the shuttle and the housing includes a guide movable in the guide track as the lint tool is moved between the stowed position and the deployed position.

10. The lint brush of claim 1, wherein the lint tool rotates in the first direction transverse to the longitudinal axis from the deployed position to the first rotated position, and the lint tool is rotatable in a second opposite direction transverse to the longitudinal axis from the deployed position to a second rotated position by moving the lint-removing material in the second direction across the associated surface to be cleaned, and the biasing member is configured to move the lint tool from the second rotated position back to the deployed position.

11. The lint brush of claim 10, wherein the lint tool includes a shuttle and a tool body supporting the lint-removing material, the shuttle includes an arcuate-shaped guide track and the tool body includes a guide movable in the guide track as the lint tool is rotated between the deployed position and one of the first rotated position and the second rotated position.

12. The lint brush of claim 11, wherein the biasing member is a spring coupled between the shuttle and the tool body.

13. The lint brush of claim 10, wherein the lint-removing material includes a continuous tool surface composed of first and second fabric sections with oppositely-oriented fabric piles.

14. A lint brush comprising:

a housing;

a lint tool including a shuttle and a tool body having a lint-removing material mounted thereto, the lint tool including the shuttle and the tool body movable along a longitudinal axis of the housing between a stowed position where the lint tool is housed in the housing and a deployed position where the tool body is extended from the housing, wherein the tool body is freely supported on and moveably relative to the shuttle allowing the tool body to be rotatable relative to the longitudinal axis from the deployed position to a first rotated position; and an actuator provided as part of the lint tool and coupled between the shuttle and the tool body, the actuator configured to move the tool body relative to the shuttle from the first rotated position back to the deployed position, wherein the housing is configured to be gripped by a user to allow the tool body to rotate relative to the longitudinal axis from the deployed position to the first rotated position.

15. The lint brush of claim 14, wherein the tool body rotates in a first direction relative to the longitudinal axis from the deployed position to the first rotated position, and the tool body is rotatable in a second opposite direction relative to the longitudinal axis from the deployed position to a second rotated position, and the actuator is configured to move the tool body relative to the shuttle from the second rotated position back to the deployed position.

16. The lint brush of claim 15, wherein the shuttle includes an arcuate-shaped guide track and the tool body includes a guide movable in the guide track as the tool body is rotated between the deployed position and one of the first rotated position and the second rotated position.

17. The lint brush of claim 14, wherein a cleaning pad is mounted within the housing, the cleaning pad adapted to engage the lint-removing material and remove fibrous material from the lint-removing material;

a collection area is defined within the housing for collecting fibrous material removed from the lint-removing material; and a door is mounted to the housing, the door movable from a closed position covering the collection area and an opened position allowing for removal of fibrous material from the collection area.

18. The lint brush of claim 14, wherein the lint-removing material includes a continuous tool surface composed of first and second fabric sections with oppositely-oriented fabric piles.

19. A lint brush comprising:

a housing;

a lint tool having a lint-removing material, the lint tool movable along a longitudinal axis of the housing between a stowed position where the lint tool is housed in the housing and a deployed position where the lint tool is extended from the housing, wherein the lint tool is rotatable relative to the longitudinal axis from the deployed position to a first rotated position; and an actuator mounted to one of the housing and the lint tool, the actuator configured to move the lint tool from the first rotated position back to the deployed position, wherein the housing includes a collection area for collecting fibrous material removed from the lint-removing material, and a door is mounted to the housing, the door movable from a closed position for covering the collection area and an opened position allowing for removal of fibrous material from the collection area.

20. The lint brush of claim 19, wherein the lint tool rotates in a first direction relative to the longitudinal axis from the deployed position to the first rotated position, and the lint tool is rotatable in a second opposite direction relative to the longitudinal axis from the deployed position to a second rotated position, and the actuator is configured to move the lint tool from the second rotated position back to the deployed position.

* * * * *